US012137806B2

(12) United States Patent
Cooper et al.

(10) Patent No.: US 12,137,806 B2
(45) Date of Patent: Nov. 12, 2024

(54) INFLATABLE SEATING APPARATUS

(71) Applicant: BOTE, LLC, Miramar Beach, FL (US)

(72) Inventors: Corey Cooper, Destin, FL (US); Aaron May, Parker, CO (US)

( * ) Notice: Subject to any disclaimer, the term of this patent is extended or adjusted under 35 U.S.C. 154(b) by 13 days.

(21) Appl. No.: 17/664,212

(22) Filed: May 19, 2022

(65) Prior Publication Data

US 2022/0273106 A1 Sep. 1, 2022

Related U.S. Application Data

(63) Continuation-in-part of application No. 17/443,504, filed on Jul. 27, 2021, now abandoned.

(51) Int. Cl.
*A47C 15/00* (2006.01)

(52) U.S. Cl.
CPC ..... *A47C 15/006* (2013.01); *A47C 15/00* (2013.01); *A47C 15/004* (2013.01)

(58) Field of Classification Search
CPC ..... A47C 15/006; A47C 15/00; A47C 15/004
See application file for complete search history.

(56) References Cited

U.S. PATENT DOCUMENTS 3,117,327 A * 1/1964 Mathew ..... A47C 15/006 297/411.44
3,740,095 A * 6/1973 Nail ..... B63B 34/52 441/130
3,984,888 A * 10/1976 DeLano ..... B63C 9/28 297/19
4,115,888 A * 9/1978 Sievers ..... B63B 34/50 440/38
4,662,852 A * 5/1987 Schneider ..... A47C 15/006 297/452.13
5,004,296 A * 4/1991 Ziegenfuss, Jr. .... A47C 15/006 297/452.41
5,403,220 A * 4/1995 Goad, Sr. ..... B63B 34/10 441/130
6,045,423 A * 4/2000 Silvia ..... B63B 34/50 441/130
6,746,293 B1 * 6/2004 Kirby, Jr ..... A47C 15/006 4/492
7,025,418 B1 * 4/2006 Hackal ..... B63H 25/42 441/130
7,331,074 B2 * 2/2008 Wu ..... A47C 17/045 5/723
7,370,379 B2 * 5/2008 Zheng ..... A47C 1/146 297/452.41
9,139,263 B2 * 9/2015 Rubey ..... G01N 33/56911
9,144,318 B1 * 9/2015 Lagier ..... A47C 3/16
9,486,083 B2 * 11/2016 Berenson ..... B63B 34/52
9,924,801 B1 * 3/2018 Green, Sr. ..... A47C 1/143
10,010,184 B2 * 7/2018 Berenson ..... A47C 15/006
11,325,684 B2 * 5/2022 Bai ..... B63B 7/08
(Continued)

*Primary Examiner* — Nkeisha Smith
(74) *Attorney, Agent, or Firm* — BakerHostetler

(57) ABSTRACT

The present invention surrounds a seating apparatus having an arm-rest assembly configured to traverse behind a seat-back, and arm-rests which extend forward of the seat back. Embodiments discussed herein include an inflatable chamber for providing positive buoyancy and structure. Certain embodiments of the present invention are configured primarily for use in a body of water, while other embodiments are configured for use in water or upon a surface.

19 Claims, 6 Drawing Sheets

(56) References Cited

U.S. PATENT DOCUMENTS

| | | | | |
|---|---|---|---|---|
| 2006/0163935 | A1* | 7/2006 | Harris | A47C 4/54 297/452.41 |
| 2015/0197323 | A1* | 7/2015 | Cerdas | B63C 9/11 441/40 |
| 2015/0289663 | A1* | 10/2015 | Berenson | B63B 34/52 441/130 |
| 2020/0155400 | A1* | 5/2020 | Owens | A61G 7/1051 |
| 2020/0307118 | A1* | 10/2020 | Hjerpe | B29C 66/1122 |
| 2020/0307154 | A1* | 10/2020 | Hjerpe | B32B 37/16 |

* cited by examiner

SECTION A-A

INFLATABLE SEATING APPARATUS

CROSS REFERENCE TO RELATED APPLICATIONS

This application claims the benefit of U.S. Provisional patent application Ser. No. 29/790,858 entitled INFLATABLE CHAIR and filed on Dec. 17, 2021, U.S. patent application Ser. No. 17/165,337 entitled DROP STITCH INFLATABLE SEAT and filed on Feb. 2, 2021, U.S. patent application Ser. No. 17/443,504 entitled MAGNETIC CONNECTION APPARATUS and filed on Jul. 27, 2021, U.S. patent application Ser. No. 17/350,845 entitled MAGNETIC DRINKWARE and filed on Jun. 17, 2021, U.S. patent application Ser. No. 17/033,067 entitled MAGNETIC ACCESSORY SURFACE MOUNT and filed on Sep. 25, 2020, and U.S. patent application Ser. No. 17/661,726 entitled MODULAR INFLATABLE PLATFORM SYSTEM and filed on May 2, 2022, the entire contents of each of which are incorporated herein by reference in their entirety for all purposes.

FIELD OF THE INVENTION

The present invention is directed to an inflatable or positively buoyant seating apparatus. Certain embodiments surround a seating apparatus having at least one inflatable chamber. Certain embodiments comprise seating apparatus configured for use in a body of water, and certain embodiments discussed herein are configured for use on a firm surface.

BACKGROUND OF THE INVENTION

Inflatable furniture and inflatable products, referred herein as inflatables, devised for outdoor recreation and leisure provide a buoyancy to keep users partially or entirely above the surface of the water on which they are deployed.

Inflatable furniture has traditionally been relegated to inflatable technology wherein the construction only allows for low pressures of about 1 PSI above atmospheric pressure. Pressures in excess would result in the loss of the form of the inflatable and/or the rupturing of the inflatable chamber. As a result, the positively buoyant furniture having inflatable chambers do not provide ample buoyancy for comfort or ample rigidity to maintain the form of the furniture or provide comfort to the user. Alternatively, the manufacture of positively buoyant furniture, such as chairs, has commonly used positively buoyant rigid materials such as closed-cell extruded polystyrene foam.

Traditional inflatable furniture capable of higher pressures—greater than 1 PSI above atmospheric pressure—have been limited to spherical and cylindrical elements due to the form that inflatable elements naturally take. These traditional inflatable products include rafts which rely upon adjoined cylindrical chambers which dictate the external form of the inflatable. Accordingly, there is a need for inflatable furniture—such as seating apparatus—wherein drop-stitch construction enables the construction of inflatables with planar surfaces and other forms, which do not rely upon cylindrically shaped chambers, while allowing for pressures greater than 1 PSI, and in some cases between 5-10 PSI, and in some cases in excess of 10-15 PSI, to provide rigid structures in both compression and tension and to provide positively buoyant furniture.

SUMMARY OF THE INVENTION

It is an aspect of certain embodiments of the present invention to provide a seating apparatus configured to be positively buoyant primarily through the use of inflatable chambers. However, alternate embodiments of the present invention which comprise the structures disclosed herein in a non-inflatable embodiment, or embodiments which are not positively buoyant are within the spirit and scope of the present invention.

It is a certain aspect of certain embodiments of the present invention to provide a positively buoyant seating apparatus wherein a user is able to sit in the seating apparatus with a portion of the seating apparatus below water-line and a portion of the seating apparatus above water-line.

It is an aspect of certain embodiments of the present invention to provide a positively buoyant apparatus wherein a user sits therein with a portion of their body, including a lower portion of their torso submerged and an upper portion of the body is maintained above water.

It is a certain aspect of certain embodiments of the present invention to provide a positively buoyant seating apparatus wherein portions of the seating apparatus comprise a surface wherein items such as beverages and the like can be placed and secured.

It is an aspect of certain embodiments of the present invention to provide a collapsible seating apparatus wherein the seating apparatus comprises inflatable chambers which provide structures intended to be used in tension, compression, and/or placed under moment loads.

It is an aspect of certain embodiments of the present invention to secure and interconnect beverages and other personal items to a seating apparatus using magnetic apparatus. Personal items include, but are not limited to: keys, cameras, pocket knives, or other items that have ferrous metal components that are desirably carried by outdoor sportspeople while engaged in fishing, paddling, boating, sailing, and other outdoor sports. Such technologies are disclosed by U.S. patent application Ser. No. 17/350,845 and U.S. patent application Ser. No. 17/443,504. Although certain embodiments disclosed herein comprise a magnetic apparatus interconnected with a top surface of an arm rest, alternate embodiments wherein a magnetic apparatus is interconnected to alternate surfaces of the seating apparatus are within the spirit and scope of the present invention.

It is an aspect of certain embodiments of the present invention to provide an inflatable seating apparatus configured to be used on a firm surface such as on the ground, boat deck, or other inflatable surface such as disclosed in U.S. patent application Ser. No. 17/661,726.

It is an aspect of certain embodiments of the present invention to interconnect an inflatable seating apparatus with a modular inflatable platform system as disclosed U.S. patent application Ser. No. 17/661,726. In certain embodiments the seating apparatus comprises at least one interconnection point, such as a D-ring, shackle, or other lashing points, configured to receiving a tether therethrough for interconnection of the first inflatable platform and the second inflatable platform.

It is an aspect of certain embodiments of the present invention to provide at least one handle interconnected with a top surface the arm-rest assembly, a lateral surface of the arm-rest assembly, or an upper aspect of the seat-back.

It is an aspect of certain embodiments of the present invention to provide at least one buoyant planar arm-rest assembly having a location for interconnecting a buoyant seat-back assembly.

These and other advantages will be apparent from the disclosure of the inventions contained herein. The above-described embodiments, objectives, and configurations are neither complete nor exhaustive.

As will be appreciated, other embodiments of the invention are possible using, alone or in combination, one or more of the features set forth above or described in detail below. Further, this Summary is neither intended nor should it be construed as being representative of the full extent and scope of the present invention. The present invention is set forth in various levels of detail in this Summary, as well as in the attached drawings and the detailed description below, and no limitation as to the scope of the present invention is intended to either the inclusion or non-inclusion of elements, components, etc. in this Summary. Additional aspects of the present invention will become more readily apparent from the detailed description, particularly when taken together with the drawings, and the claims provided herein.

DETAILED DESCRIPTION OF VARIOUS EMBODIMENTS

Figure 1A:
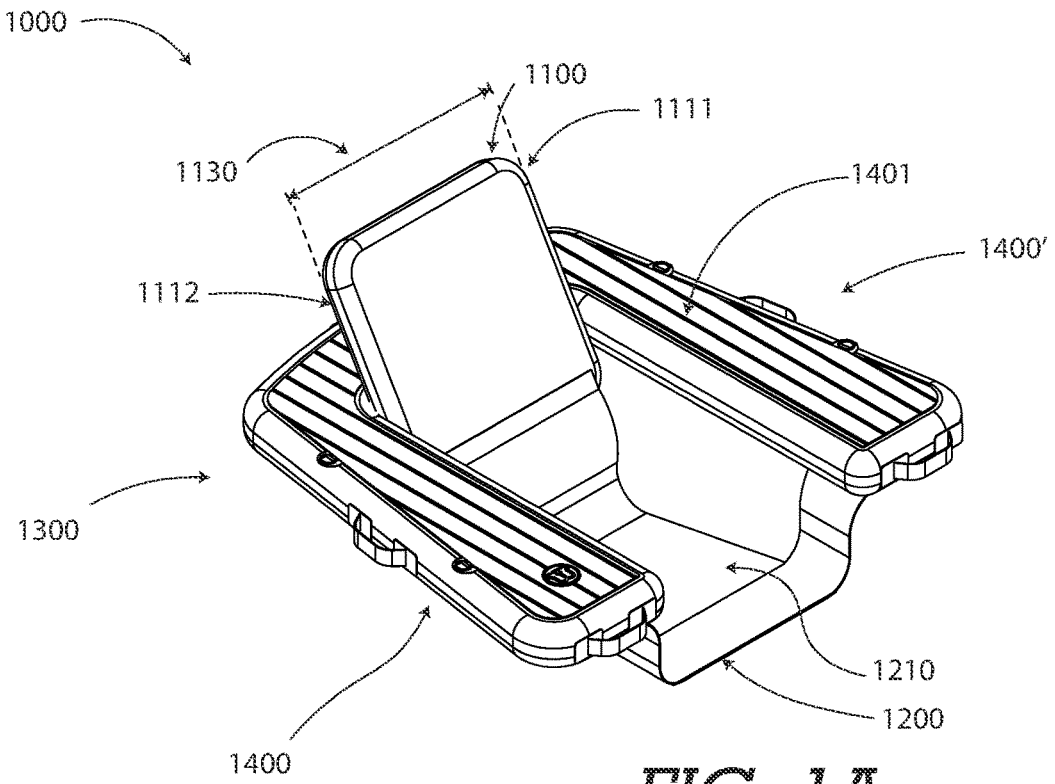
FIG. 1A—A perspective view of certain embodiments comprising a seating apparatus FIG. 1B—A side view of certain embodiments comprising a seating apparatus FIG. 2A—A top view of certain embodiments of the present invention comprising an arm-rest assembly FIG. 2B—A cross-sectional view of the arm-rest assembly as shown in FIG. 2A FIG. 3A—A perspective view of certain embodiments comprising a seating apparatus FIG. 3B—A side view of certain embodiments comprising a seating apparatus FIG. 4A—A front view of certain embodiments comprising a seating apparatus FIG. 4B—A cross-sectional view of the seating apparatus as shown in FIG. 4A FIG. 5A—A side view of certain embodiments comprising a seating apparatus FIG. 5B—A front view of certain embodiments comprising a seating apparatus FIG. 6—A perspective view of certain embodiments comprising a seating apparatus FIG. 7—A perspective view of certain embodiments comprising a seating apparatus
Figure 1B:
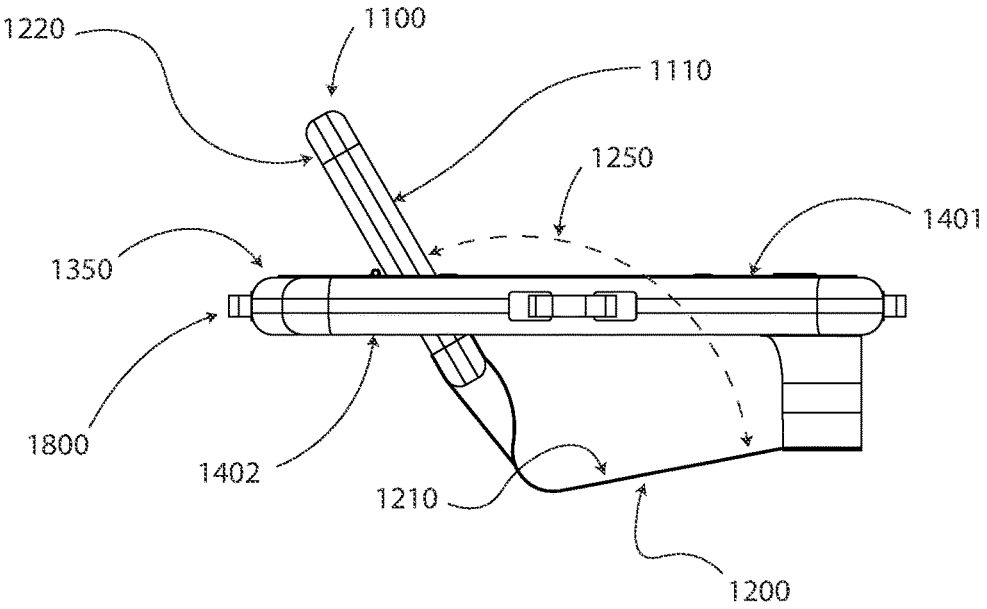

Certain embodiments of the present invention, as shown in FIG. 1A-FIG. 1B for instance, comprise a seating apparatus 1000. The seating apparatus comprises a seat-back 1100, and a seat-bottom 1200. The seat bottom 1200 comprises a top surface 1210, which is disposed at an angle 1250 greater than 90-degrees from a front surface 1110 of the seat-back. In certain embodiments, the seat-back 1100 comprises drop-stitch construction. The seating apparatus 1000 further comprises an arm-rest assembly 1300 comprising a first arm-rest 1400 and a second arm-rest 1400' and a cross member 1350 arranged in a C or horseshoe shape. As shown in FIG. 1B, the arm-rest assembly 1300 further comprises a substantially planar upper surface 1401, a substantially planar lower surface 1402, and the first arm-rest 1400 and a second arm-rest 1400' and a cross member 1350 are coplanar. The width 1355 of the cross-member 1350 of certain embodiments is equal-to or greater-than the width 1130 of the seat-back. The cross-member 1350 is configured to traverse behind the seat-back 1100. In certain embodiments, the cross-member 1350 is configured to support the seat-back and maintain a consistent angle 1250 between the seat-back 1100 and the seat-bottom 1200.

In certain embodiments of the present invention, a rear surface 1120 of seat-back 1100 is interconnected with the arm-rest assembly 1300 in a manner that allows the seat-back to rotate or flex relative to the arm-rest assembly to reduce or increase angle 1250. For example, in certain embodiments, the rear surface 1120 of the seat-back is hingedly interconnected with the cross-member 1350 of the arm-rest assembly. In certain embodiments, the seat-back 1100 is interconnected with the arm-rest assembly 1300 with a living hinge or other flexible connection such as a polymeric sheet material, while in alternate embodiments the seat-back is interconnected with the arm-rest assembly 1300 with a pinned connection. In certain embodiments of the present invention, seat-back 1100 is rotatably interconnected with cross-member 1350. In certain other embodiments, seat-back 1100 is interconnected with cross-member 1350 by the rail and track hinge described and shown in U.S. patent application Ser. No. 17/165,337.

In certain embodiments, arm-rests 1400 and 1400' are configured to extend forward of the seat-back 1100 from cross-member 1350 of the arm-rest assembly, wherein first arm-rest 1400 extends forward of the seat-back 1100 on a first side 1111 of the seat-back and second arm-rest 1400' extends forward of the seat back 1100 on a second side 1112 of the seat-back.

Figure 2A:
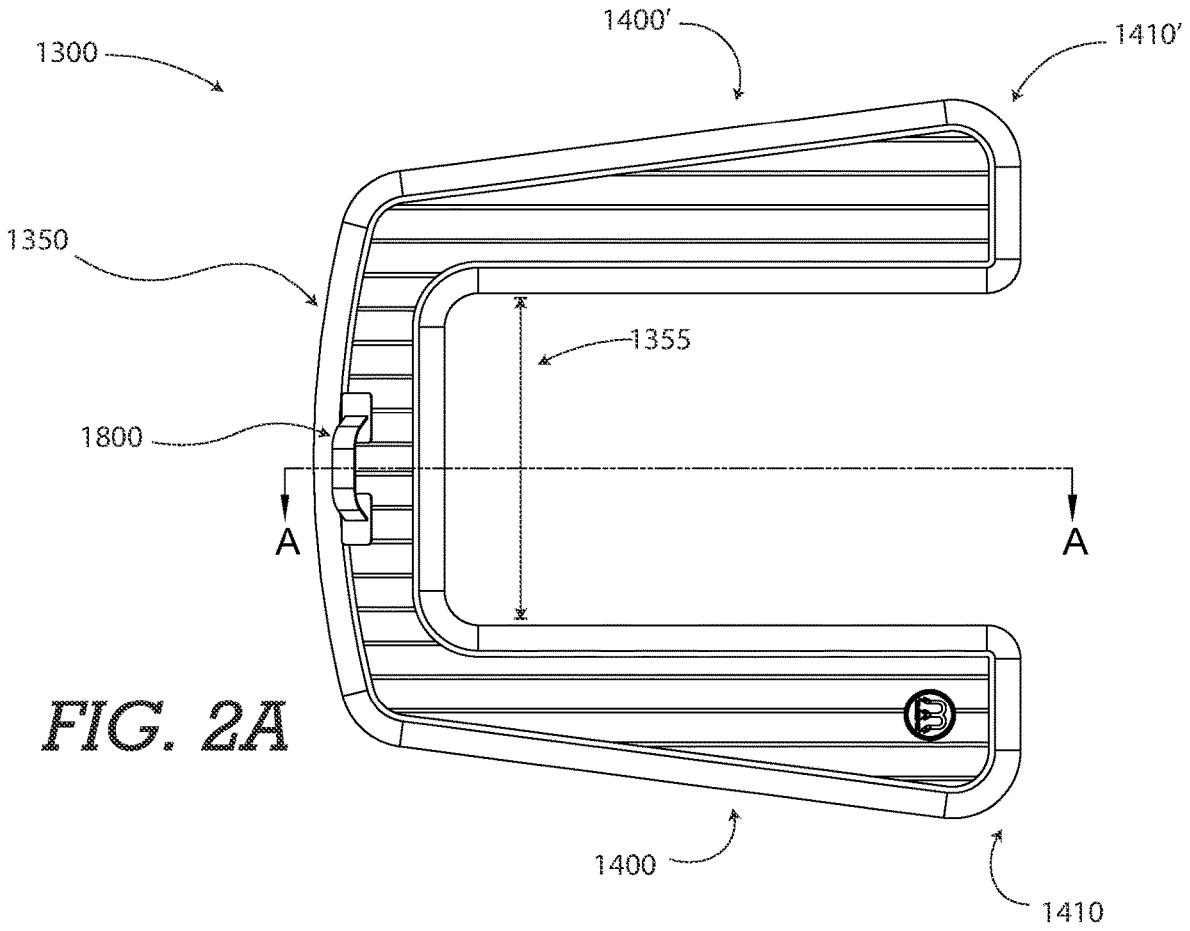
Figure 2B:
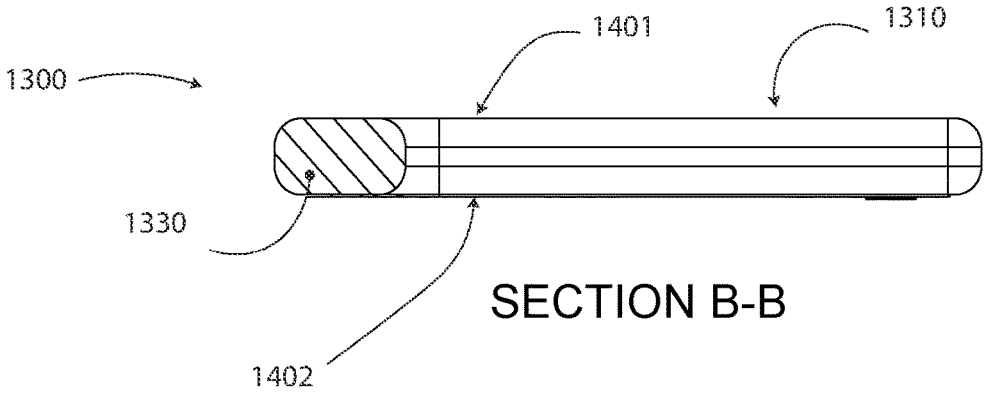
Figure 3A:
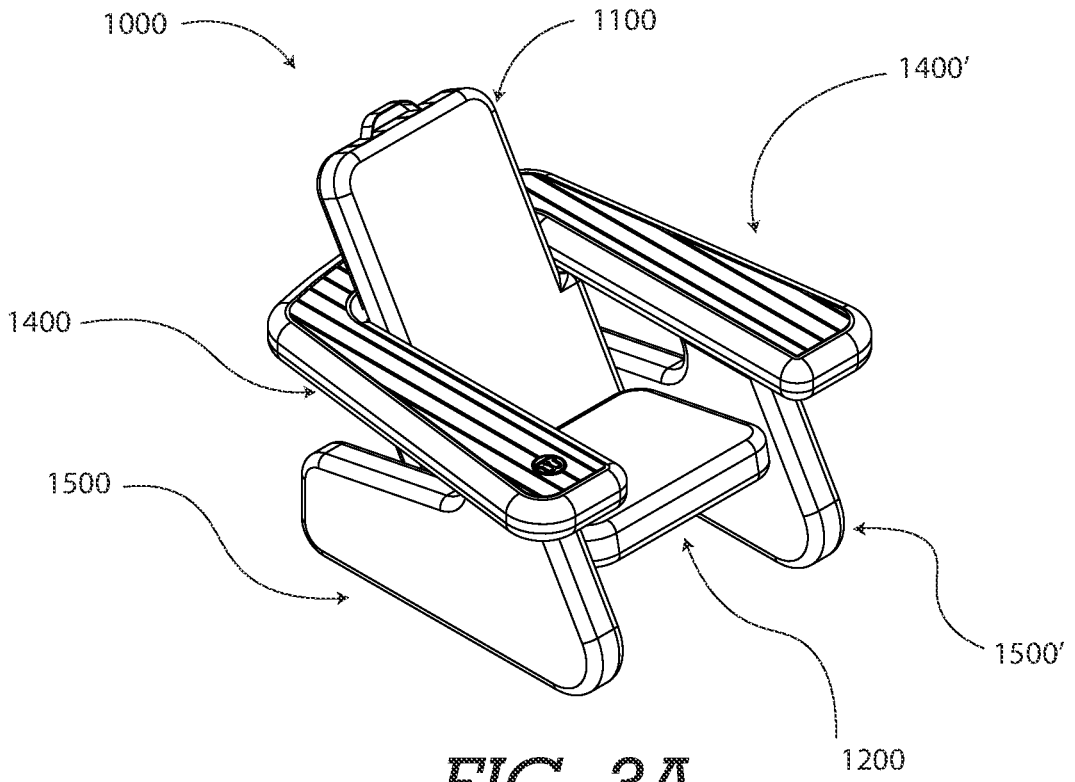
Figure 3B:
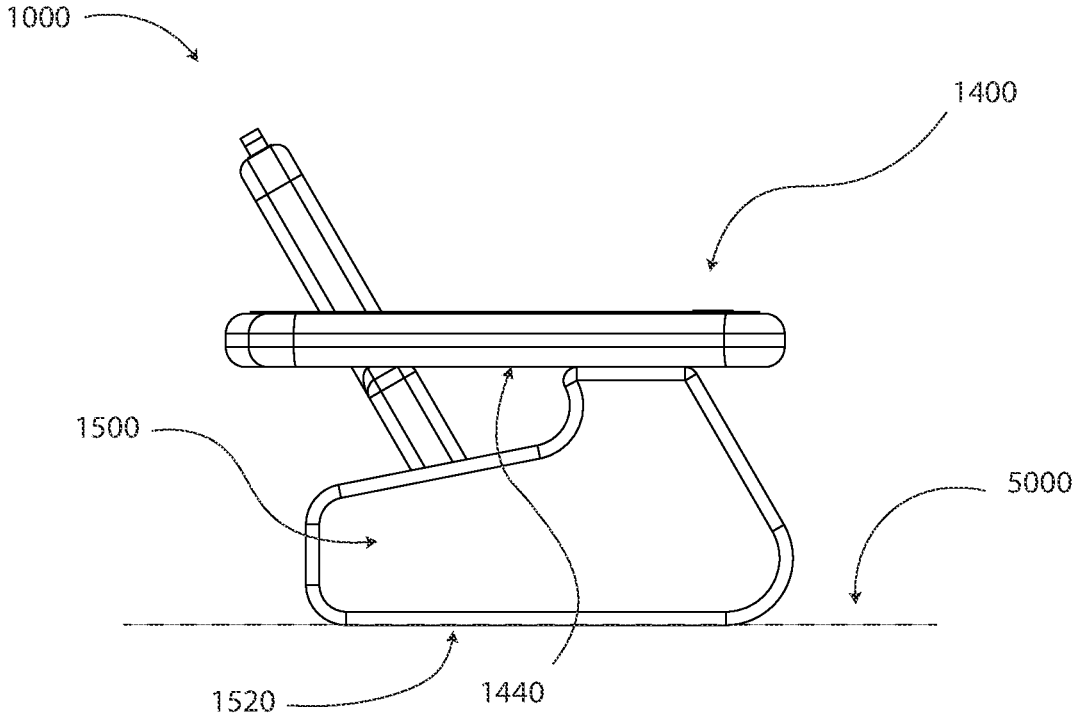

In certain embodiments, as shown in FIG. 2A-FIG. 2B for instance, an arm-rest assembly 1300 comprises a continuous inflatable chamber 1330 which extends through the arm-rest assembly 1300. Certain embodiments comprise an arm-rest assembly wherein the first arm rest 1400, the second arm rest 1400', and the cross-member 1350 each comprise an inflatable chamber 1330. In certain embodiments the arm-rest assembly 1300 comprises a plurality of inflatable chambers 1330, while alternate embodiments comprise a continuous inflatable chamber 1330 extending from a forward aspect 1410 of the first arm-rest, through cross-member 1350, and through to a forward aspect 1410' of the second arm-rest. In certain embodiments comprising a plurality of inflatable chambers 1330, the inflatable chambers are fluidly interconnected such that the chambers are adapted to maintain a substantially uniform interior air pressure. In certain embodiments, the arm-rest assembly 1300 comprises drop-stitch construction. In certain embodiments, the arm-rest assembly 1300 is buoyant.

In certain embodiments the seat-back 1100 comprises an inflatable chamber 1330. In certain embodiments the seat-back 1100 comprises a plurality of inflatable chambers 1330. In certain embodiments comprising a plurality of inflatable chambers, the inflatable chambers are fluidly interconnected such that the chambers maintain a substantially uniform interior air pressure. In certain embodiments, the seat-back 1100 comprises drop-stitch construction. In certain embodiments, the seat-back 1100 is buoyant.

In certain embodiments, as shown in FIG. 3A-FIG. 4B for instance, a first leg 1500 is interconnected to the first arm-rest 1400 and a second leg 1500' is interconnected with the second arm-rest 1400'. The legs 1500 and 1500' extend downward from a bottom surface 1440 of the arm-rests and have a bottom aspect 1520 configured to rest upon a surface 5000. In certain embodiments, the bottom aspect 1520 of the legs extend in a rearward direction wherein in some embodiments the bottom aspect of the legs extend rearward beyond the rearward extent 1270 of the seat-bottom 1200. In certain embodiments the bottom aspect of the legs 1520 extend in a forward direction, while in certain embodiments the legs extend beyond a forward extent 1260 of the seat-bottom 1200. As shown, a width 1525 of the bottom aspect 1520 of the legs is greater than a width 1515 of the top aspect of the legs, however alternate embodiments wherein the legs 1500 and 1500' have an upper aspect width 1515 which is equal to or greater than the width lower aspect width 1525 are within the spirit and scope of the present invention. While legs 1500 and 1500' shown herein comprise a bottom aspect 1520 having a generally linear bottom surface configured for continuous contact with a planar surface 5000, embodiments wherein the legs 1500 and 1500' comprise protuberances extending downward from a bottom aspect 1520 to interconnect with a surface 5000 in non-continual contact are within the spirit and scope of the present invention. In certain embodiments, the seat bottom 1200 comprises a top surface 1210, which is disposed at an angle 1250 greater than 90-degrees from a front surface 1110 of the seat-back 1100.

Figure 4A:
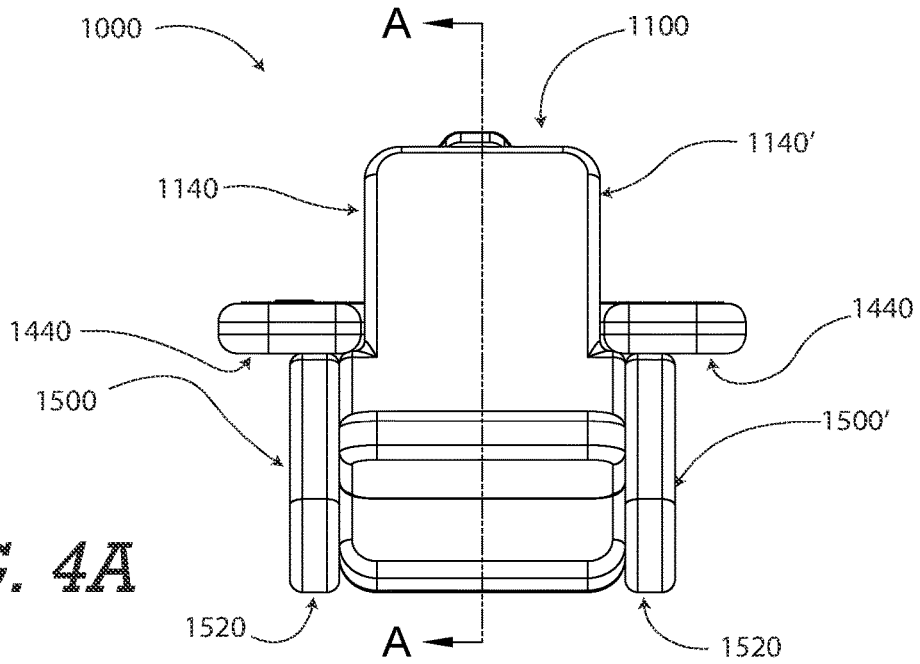
Figure 4B:
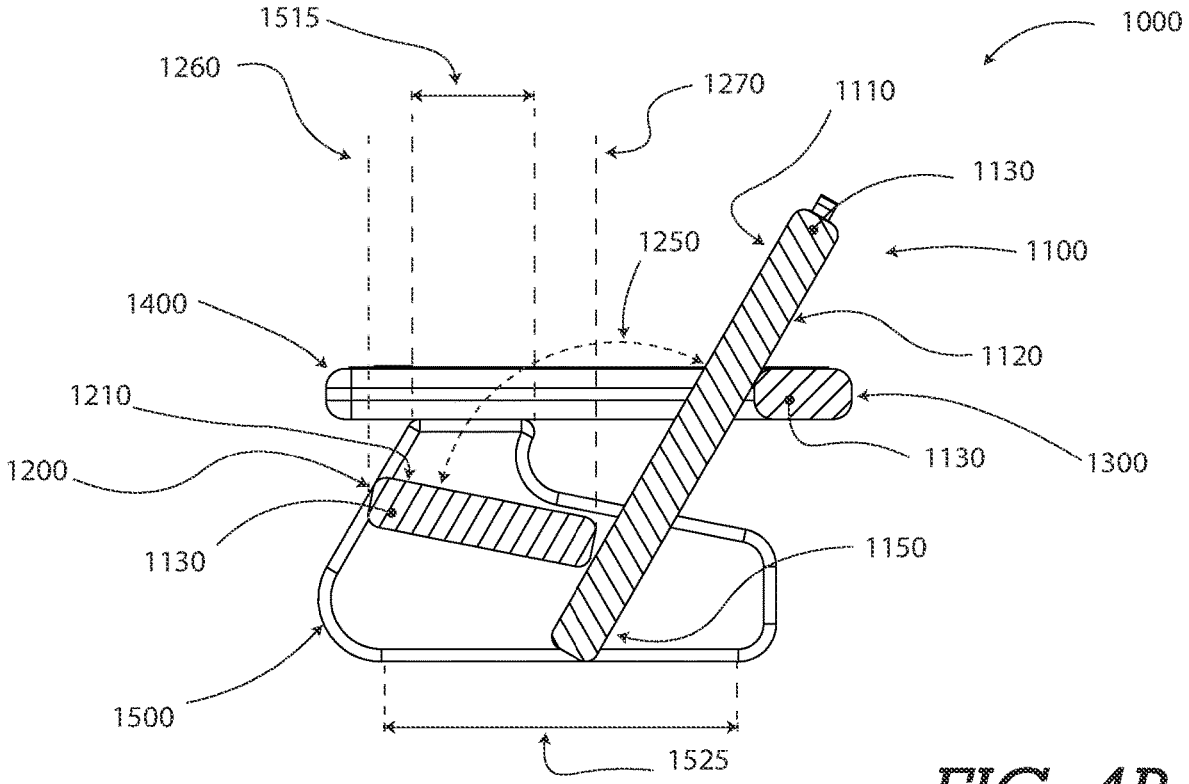

As shown in FIG. 4B for instance, certain embodiments comprise an arm-rest assembly 1300, a seat-back 1100, and a seat-bottom 1200, and legs 1500 and 1500' which each comprise an inflatable chamber 1330. In certain embodiments, the seat-bottom 1200 and/or and legs 1500 and 1500' comprise drop-stitch construction. In certain embodiments, the seat-bottom 1200 and/or and legs 1500 and 1500' are buoyant.

In certain embodiments, the seat-back 1100 has a rear surface 1120 interconnected to the arm-rest assembly 1300, a first side 1140 of the seat-back interconnected to the first leg 1500 and a second side 1140' interconnected with the second leg 1500'. In certain embodiments, as shown in FIG. 4B, the seat-back 1100 extends downward below the seat-bottom 1200, and in certain embodiments the seat-back 1100 extends downward wherein the seat-back comprises a bottom aspect 1150 configured to rest upon a surface 5000. In certain embodiments, as shown in FIG. 4B, seat bottom 1200 is interconnected to a lower aspect of the seat-back 1100.

Figure 5A:
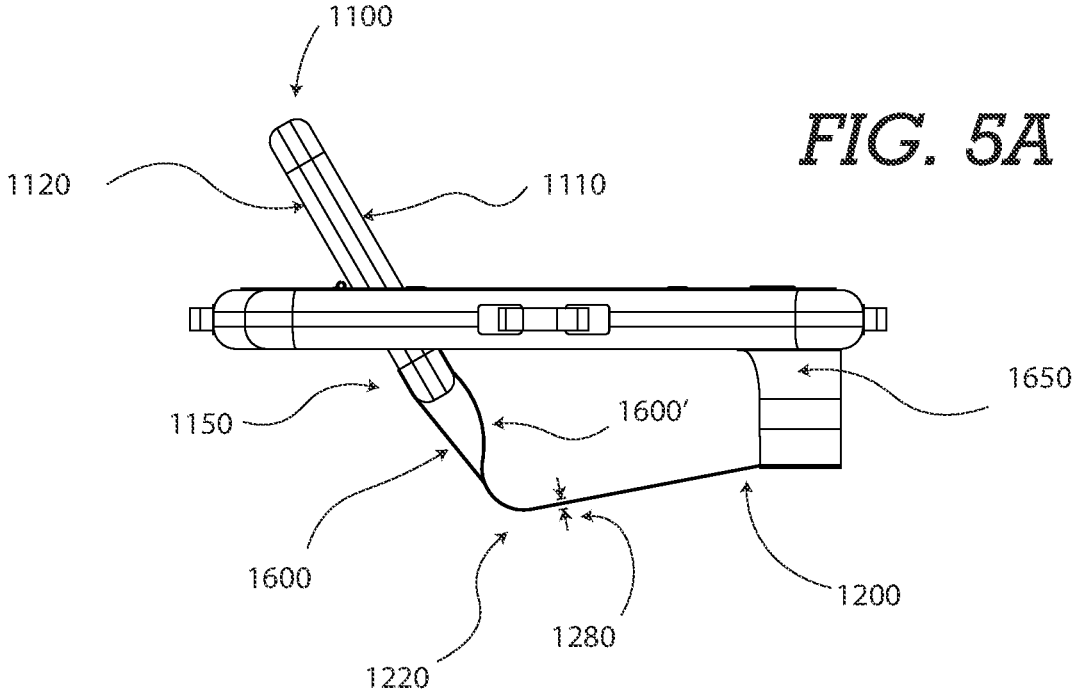
Figure 5B:
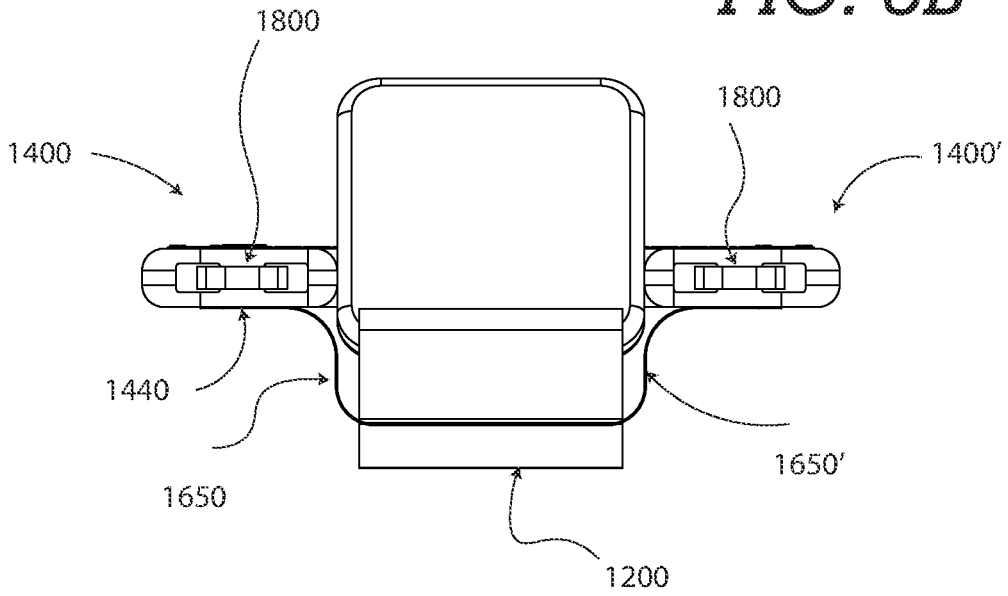

In certain embodiments, as shown in FIG. 5A-FIG. 5B for instance, a seat bottom 1200 is interconnected to a lower aspect of the seat-back 1100 with a rearward suspension 1600 element. Rearward suspension 1600 may comprise two membranes, one interconnected to rear surface 1120 and one interconnected to front surface 1110 as shown, or a single membrane interconnected either to a bottom aspect 1150 of seat-back 1100, to rear surface 1120, or to front surface 1110. In certain embodiments, the seat-bottom 1200 is interconnected with the arm-rest assembly 1300 with forward suspension elements 1650 and 1650'. In certain embodiments, forward suspension elements 1650 and 1650' comprise a flexible sheet.

In certain embodiments, the rearward aspect 1220 of the seat-bottom 1200 is interconnected with a bottom aspect 1150 of the seat-back, and the forward aspect of the seat-bottom is interconnected with the arm-rest assembly 1300 wherein a first forward suspension element 1650 interconnects between the first arm-rest 1400 and the seat-bottom 1200, and a second forward suspension element 1650' interconnects between the second arm-rest 1400' and the seat-bottom 1200. In certain embodiments, the forward suspension elements 1650 interconnect with a bottom surface 1440 of the arm-rest.

In certain embodiments, seat-bottom 1200, rearward suspension 1600, and/or suspension elements 1650 and 1650' comprise a flexible sheet-form construction such as a polymeric sheet material. Polymeric sheet materials as discussed herein include, without limitation, PVC, urethane, and chlorosulfonated polyethylene synthetic rubber. In certain embodiments, the polymeric sheet material is sufficiently non-buoyant such that the seat-bottom does not tend to float up when the seating apparatus 1000 is placed in water. As used herein, "non-buoyant" means an average density that is about equal to or greater than the density of water at temperatures from 0 to 120 degrees Fahrenheit, i.e., a density from about 0.95 to 1 grams/cm$^3$ to greater than 1 gram/cm$^3$. In certain alternative embodiments, the seat-bottom 1200, rearward suspension 1600, and/or suspension elements 1650 and 1650' comprise a portion of weighted material in order to create an overall average density that is greater than the density of water. Such portions may include metal weights or weights made from other dense materials.

In certain embodiments, the seat-bottom comprises a sheet-form construction wherein the thickness of the seat-bottom is limited to the thickness 1280 of the sheet-form. In certain embodiments, the seat-bottom 1200, rearward suspension element 1600, and forward suspension elements 1650 are constructed from a unitary piece of sheet-form material such as the flexible sheet materials discussed above.

In certain embodiments, a rearward suspension element comprises a first portion 1600 configured to interconnect with the front surface 1110 of the seat-back, and a second portion 1600' configured to interconnect with the rearward surface 1120 of the seat-back. Although embodiments shown herein disclose a seat-bottom 1200 interconnected with a seat-back 1100, embodiments wherein a rearward aspect 1220 of the seat-bottom are interconnected with the arm-rest assembly 1300 or arm-rests 1400 are within the spirit and scope of the present invention.

Figure 6:
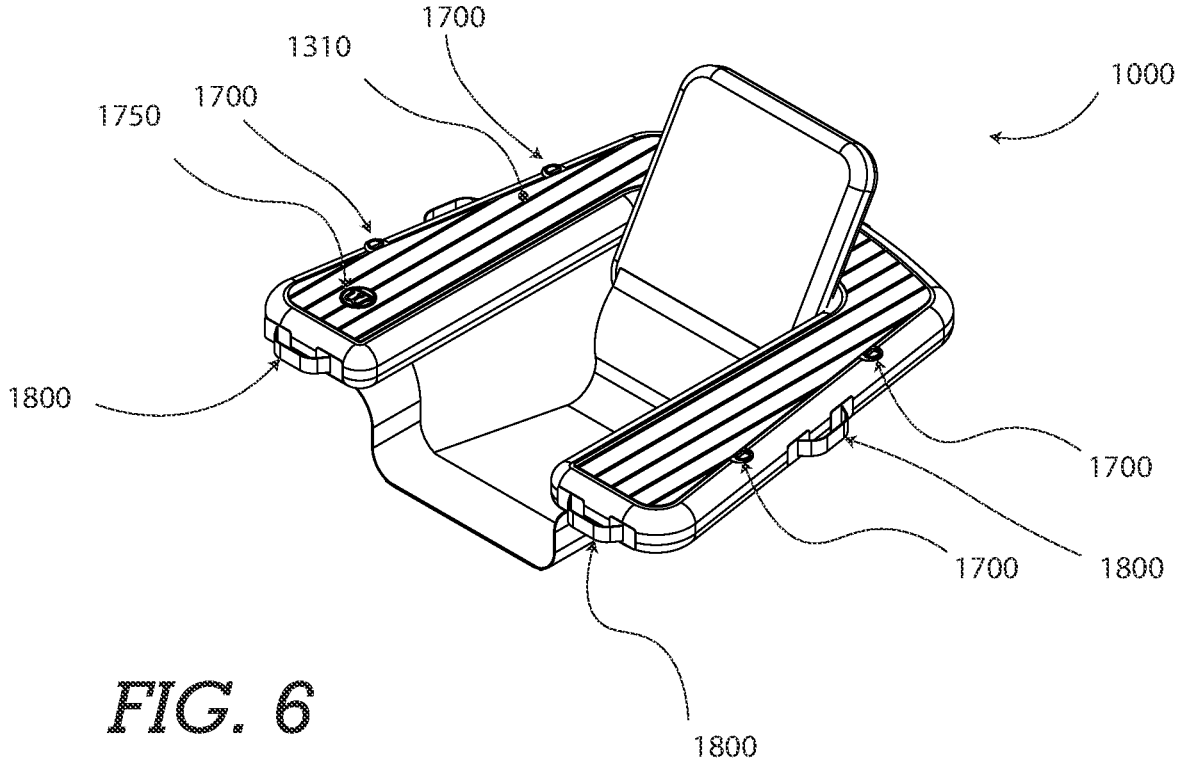

Certain embodiments of the present invention, as shown in FIG. 6 for instance, comprise interconnection points 1700 such as lashing points configured to receive a tethering device. The interconnection points of certain embodiments are interconnected with a top surface 1310 of the arm-rest assembly.

Figure 7:
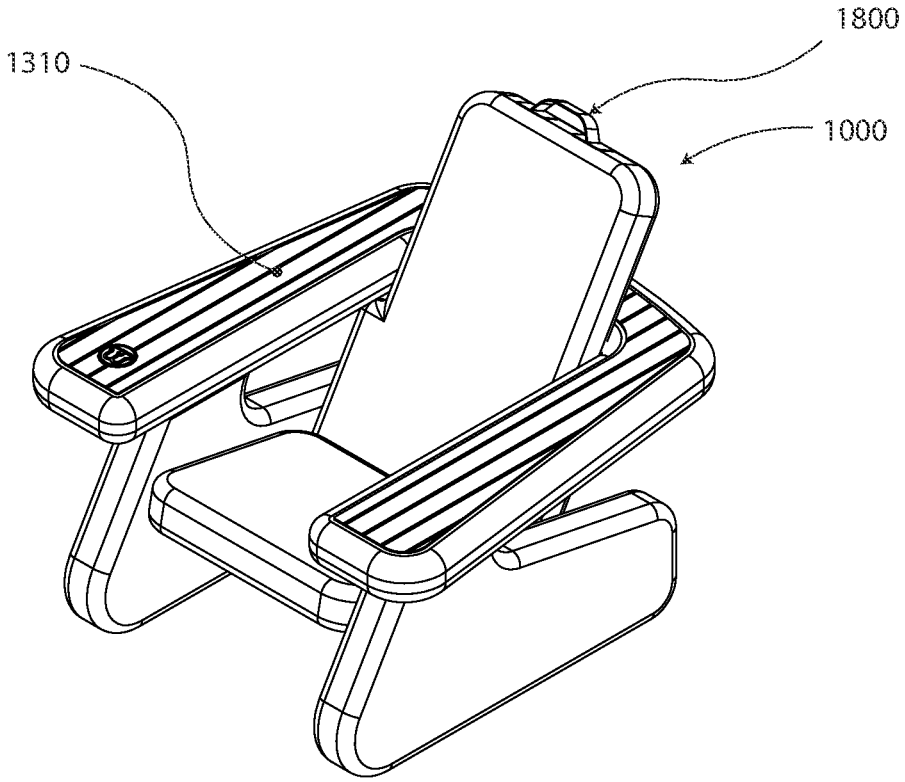

Certain embodiments, as shown in FIG. 6-FIG. 7 for instance, comprise a magnetic apparatus 1750 such as those disclosed in U.S. patent application Ser. Nos. 17/443,504, 17/350,845, and 17/033,067. In certain embodiments, a magnetic apparatus 1750 is interconnected with a top surface 1310 of the arm-rest assembly. In certain embodiments, a magnetic apparatus 1750 is interconnected to a forward aspect 1410 of the first arm-rest and/or a forward aspect 1410' of the second arm-rest.

Certain embodiments of the present invention, as shown in FIG. 6-FIG. 7 for instance, comprise handles 1800 configured to allow a user to thereby carry, push, pull a seating apparatus. The handles as shown are interconnected to a side perimetral aspect of the arm-rest assembly and on an upper aspect of the seat-back, however, the location of the handles are not limited thereto.

While various embodiments of the present invention have been described in detail, it is apparent that modifications and alterations of those embodiments will occur to those skilled in the art. However, it is to be expressly understood that such modifications and alterations are within the scope and spirit of the present invention. Further, the inventions described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as additional items.

What is claimed is:

1. A seating apparatus comprising:

an inflatable seat-back comprising a rear surface;

a seat-bottom interconnected to the seat-back;

an inflatable arm-rest assembly comprising a first arm-rest, a second arm-rest, and a cross-member;

a rearward suspension element interconnected between a rearward aspect of the seat-bottom and the seat-back;

a first forward suspension element interconnected between a forward aspect of the seat-bottom and the first arm-rest; and a second forward suspension element interconnected between the forward aspect of the seat-bottom and the second arm-rest;

wherein the rear surface of the seat-back is interconnected to the cross-member; and wherein the first arm-rest is configured to extend forward of the seat-back on a first side of the seat-back and the second arm-rest is configured to extend forward of the seat-back on a second side of the seat-back.

2. The seating apparatus of claim 1, wherein the seat-back is adapted to rotate relative to the cross-member.

3. The seating apparatus of claim 1, wherein the rear surface of the seat-back is hingedly interconnected with the arm-rest assembly.

4. The seating apparatus of claim 1, wherein the arm-rest assembly comprises a substantially planar upper surface and a substantially planar lower surface.

5. The seating apparatus of claim 1, wherein the first arm-rest, second arm-rest, and cross-member are co-planar.

6. The seating apparatus of claim 1, further comprising a magnetic connection apparatus interconnected to a top surface of the first arm-rest or the second arm-rest.

7. The seating apparatus of claim 1, wherein the arm-rest assembly comprises a plurality of inflatable chambers.

8. The seating apparatus of claim 1, wherein the seat-back and arm-rest assembly comprise drop-stitch construction.

9. The seating apparatus of claim 8, wherein the seat-back and arm-rest assembly are adapted to inflate to at least about 10 PSI.

10. The seating apparatus of claim 1, wherein the seat-bottom comprises a flexible sheet.

11. The seating apparatus of claim 1, wherein the forward suspension elements, and the rearward suspension element each comprise a flexible sheet.

12. The seating apparatus of claim 11, wherein the seat-bottom and forward suspension elements comprise a unitary piece of flexible sheet.

13. The seating apparatus of claim 11, wherein the rearward suspension element comprises:

a first portion configured to interconnect with the front surface of the seat-back; and a second portion configured to interconnect with a rear surface of the seat-back.

14. The seating apparatus of claim 1, wherein the arm-rest assembly is buoyant, and the seat-bottom is non-buoyant.

15. A seating apparatus comprising:

an inflatable seat-back comprising a rear surface;

a seat-bottom interconnected to the seat-back;

an inflatable arm-rest assembly comprising a first arm-rest, a second arm-rest, and a cross-member;

a first leg having a top aspect interconnected to a bottom surface of the first arm-rest and extending vertically downward below a bottom surface of the seat-bottom; and a second leg having a top aspect interconnected to a bottom surface of the second arm-rest and extending vertically downward below the bottom surface of the seat-bottom;

wherein the rear surface of the seat-back is interconnected to the cross-member;

wherein the first arm-rest is configured to extend forward of the seat-back on a first side of the seat-back and the second arm-rest is configured to extend forward of the seat-back on a second side of the seat-back;

wherein the seat-back and arm-rest assembly comprise drop-stitch construction; and wherein a bottom aspect of the first leg and a bottom aspect of the second leg are configured to rest on a surface to support the seating apparatus.

16. The seating apparatus of claim 15, wherein the first leg and second leg comprise drop-stitch construction.

17. The seating apparatus of claim 16, wherein the top aspects of the legs interconnect with the arm-rests above the seat-bottom, and wherein the bottom aspects of the legs extend rearward beyond a rearward extent of the seat-bottom.

18. The seating apparatus of claim 16, wherein the bottom aspects of the legs extend forward beyond a forward extent of the seat-bottom.

19. The seating apparatus of claim 16, further comprising a first magnetic connection apparatus interconnected with a top surface of the arm-rest assembly.

* * * * *